US005330961A

United States Patent [19]

Takeyama et al.

[11] Patent Number: 5,330,961

[45] Date of Patent: Jul. 19, 1994

[54] IMAGE RECEIVING SHEET FOR THERMAL TRANSFER RECORDING AND PROCESS FOR PREPARING THE SAME

[75] Inventors: Toshihisa Takeyama; Shigehiro Kitamura; Kunihiro Koshizuka, all of Tokyo, Japan

[73] Assignee: Konica Corporation, Tokyo, Japan

[21] Appl. No.: 940,668

[22] Filed: Sep. 4, 1992

[30] Foreign Application Priority Data

Sep. 12, 1991 [JP] Japan ..... 3-233247

[51] Int. Cl.[5] ..... B41M 5/035; B41M 5/38

[52] U.S. Cl. ..... 503/227; 428/195; 428/318.4; 428/319.3; 428/480; 428/483; 428/913; 428/914

[58] Field of Search ..... 8/471; 428/195, 318.4, 428/319.3, 207, 913, 914, 480, 483; 503/227

[56] References Cited

U.S. PATENT DOCUMENTS 4,778,782 10/1988 Ito et al. ..... 503/227

*Primary Examiner*—B. Hamilton Hess

*Attorney, Agent, or Firm*—Frishauf, Holtz, Goodman & Woodward

[57] ABSTRACT

Disclosed are an image receiving sheet for thermal transfer recording comprising: a support and an image receiving layer which contains a resin having dyeing affinity for a thermally diffusible dye provided thereon, wherein the support comprises a substrate and a laminated resin sheet which contains porous resin films each having a density in the range of 0.5 to 1.2 g/cm$^3$ provided on both surfaces of the substrate, and a process for preparing the image receiving sheet for thermal transfer recording, comprising: a step of pasting a substrate and a resin film with an adhesive to produce a laminated resin sheet used as the support.

9 Claims, No Drawings

IMAGE RECEIVING SHEET FOR THERMAL TRANSFER RECORDING AND PROCESS FOR PREPARING THE SAME

BACKGROUND OF THE INVENTION

This invention relates to an image receiving sheet for thermal transfer recording, more specifically to an image receiving sheet for thermal transfer recording, which is not curled during printing, has excellent dimensional stability and gives high transfer density, and a process for preparing the same.

In the prior art, as a system for obtaining a color hard copy, color recording techniques by ink jet, electrophotography and thermal transfer recording have been investigated. Among them, a thermal transfer recording system has such advantages that operation and maintenance are easy, an apparatus can be miniaturized and cost can be reduced, which is not limited to the case of color recording.

The thermal transfer recording system includes a thermal fusion transfer system and a thermal diffusion transfer system. The former is a system in which a thermally fusible ink sheet having a thermally fusible ink layer on a support is heated imagewisely by a laser or a thermal head, whereby said thermally fusible ink layer is fused and transferred to an image receiving sheet for thermal transfer recording. The latter is a system in which an ink sheet for sublimation type thermal transfer recording having an ink layer containing a sublimable dye on a support is used, and the above sublimable dye is diffused and transferred to an image receiving sheet for thermal transfer recording, which is also called "sublimation transfer system".

Among them, attention has been recently paid to the thermal diffusion transfer system since said system has excellent characteristics that gradation of an image can be controlled by changing the amount of a dye to be transferred in proportion to the change of heat energy of a thermal head, whereby a color image of multicolor printing having continuous change in a shade of color can be formed easily by, for example, conducting overlapping recording of three primary colors such as cyan, magenta and yellow.

That is, by developing this thermal diffusion transfer system, the thermal transfer recording method has been used not only for forming a general image such as an image of letters by the thermal fusion transfer system, but also for forming a gradational color image with multicolor (e.g. a color portrait photograph) by the thermal diffusion transfer system. Further, these images having different characteristics can be obtained extremely efficiently by using a thermal transfer printer which is a simple apparatus and by a simple operation of selecting a suitable ink sheet.

The thermal transfer recording method using the thermal diffusion transfer system has advantages as described above, so that in recent years, the method has been frequently utilized for preparing an image recording medium having a gradational color image, for example, a color photographic image. Particularly in the case of identity (ID) cards such as a membership card, it is important to record a portrait photograph in addition to various pieces of information such as a code number in order to identify oneself, which is an applicable field of the above method.

However, in a conventional image receiving sheet for thermal transfer recording according to such a thermal transfer recording method, when a thin support or a support having poor heat resistance is used, there is a problem that an image receiving sheet for thermal transfer recording is sometimes curled due to thermal shrinkage during printing.

As a means for solving these problems, a laminated support has been used as described in Japanese Provisional Patent Publications No. 198497/1987, No. 231984/1988, No. 290790/1988, No. 108040/1989, No. 3395/1990 and No. 86493/1990, a sheet-shaped coating layer for preventing curling has been pasted as described in Japanese Provisional Patent Publication No. 44781/1989, and a resin layer which is free from thermal shrinkage has been provided as described in Japanese Provisional Patent Publication No. 113992/1990.

However, these methods involve a problem that curling cannot be prevented sufficiently when a resin itself does not have sufficient heat resistance or it has poor dimensional stability. Also, in a certain aspect, it has been a serious task to develop an image receiving sheet which can form a gradational color image having high quality by the thermal diffusion transfer recording system.

In the prior art, in order to develop such an image receiving sheet, various attempts such as selection of a resin to be used in an image receiving layer and formation of a multi-layered image receiving layer have been made. However, these conventional image receiving sheets have problems that (1) density of a whole image becomes low, (2) density of a recorded image becomes uneven (generation of unevenness) and (3) white dots are generated.

Thus, in order to solve such problems, it has been attempted to provide an intermediate layer comprising various materials between an image receiving layer and a support (substrate). For example, it has been investigated to provide a thermal insulating layer or a cushion layer by using a rubber material (Japanese Provisional Patent Publications No. 258793/1986, No. 270192/1986, No. 146693/1987, No. 151393/1987 and No. 5885/1989) or a polyolefin type resin (Japanese Provisional Patent Publications No. 21590/1987 and No. 27993/1989) as a material of the intermediate layer. Further, in order to further enhance an effect of the intermediate layer, it has been proposed that the intermediate layer is made a porous layer having microvoids (Japanese Provisional Patent Publications No. 270192/1986, No. 87286/1988, No. 126788/1988, No. 145192/1989, No. 280586/1989 and No. 248289/1990). Also, as a method for forming the porous layer, there have been contrived a method of providing a porous layer by coating a solvent and a method of forming a porous layer by mixing a resin with a hollow grain.

However, in an image receiving sheet having a porous layer provided as an intermediate layer according to these conventional methods, although the above problems (1) to (3) (insufficient density and generation of unevenness and white dots) can be prevented remarkably in some cases, a process for forming the porous layer is troublesome and unsuited. From these reasons, there involve other problems that (4) smoothness of the porous layer surface becomes insufficient, whereby it is difficult to form an image receiving layer which is uniform and has excellent smoothness, (5) steps of preparing an image receiving sheet becomes extremely complicated, (6) lamination strength of an image receiving sheet is insufficient, (7) curling of a sheet is caused frequently and (8) barrier property relative to humidity, oxygen gas and a transferred dye becomes insufficient depending on the material of the support (substrate) or the intermediate layer. As to the above problem (8), there may be especially mentioned that barrier property becomes particularly insufficient when the substrate is a paper and the intermediate layer is polyolefin, or a transferred dye is printed through to a back side during storage (the so-called print through problem) when the substrate is a paper. Also as to effects of preventing the above problems (1) to (3), it is still difficult to say that the effects are sufficient in some cases.

Further, it has been proposed to make an image receiving layer itself a porous layer having microvoids in place of providing an intermediate layer as described above (Japanese Provisional Patent Publication No. 295890/1989). In this case, although relatively sufficient effects of preventing the above problems (1) to (3) can be obtained, the image receiving layer itself has a microvoid structure, so that there involves another problem that bleeding of an image is liable to be generated due to diffusion of a transferred dye during image formation and during storage after image formation.

SUMMARY OF THE INVENTION

The present invention has been made in order to solve the above problems.

An object of the present invention is to provide an image receiving sheet for thermal transfer recording, which is not curled during printing, has excellent dimensional stability, is free from generation of white dots and bleeding, has high sensitivity and gives high transfer density, and a process for preparing the same.

The above object can be accomplished by the following means.

(1) An image receiving sheet for thermal transfer recording comprising: a support and an image receiving layer which contains a resin having dyeing affinity for a thermally diffusible dye provided thereon, wherein said support comprises a substrate and a laminated resin sheet which contains porous resin films each having a density in the range of 0.5 to 1.2 g/cm$^3$ provided on both surfaces of said substrate.

(2) The image receiving sheet for thermal transfer recording described in (1) wherein the above porous resin film has a density in the range of 0.8 to 1.1 g/cm$^3$.

(3) The image receiving sheet for thermal transfer recording described in (1) wherein the above porous resin film is mainly composed of a polyester type resin.

(4) The image receiving sheet for thermal transfer recording described in (1) wherein the above porous resin film further contains a white fine grain.

(5) The image receiving sheet for thermal transfer recording described in (1) wherein the above porous resin film further contains an antistatic agent.

(6) The image receiving sheet for thermal transfer recording described in (1) wherein the above porous resin film is obtained by a method in which a porous resin film having a desired thickness is obtained by adding an incompatible resin or a filler to a resin, extruding the mixture by an extrusion method, then biaxially stretching it to generate fine voids.

(7) The image receiving sheet for thermal transfer recording described in (1) wherein the above substrate is a synthetic paper on which a white pigment layer is provided by coating on at least one surface of a polyolefin type, polyester type and/or resin film.

(8) The image receiving sheet for thermal transfer recording described in (1) wherein the above substrate is mainly composed of a resin selected from the following Group A:

Group A: polyether ether ketone, polysulfone, polyether sulfone, polyether imide, polyimide, polyphenylene sulfide, polycarbonate, a polyparabanic acid resin, a styrene type resin and an vinyl chloride type resin.

(9) A process for preparing an image receiving sheet for thermal transfer recording, having a support and an image receiving layer which contains a resin having dyeing affinity for a thermally diffusible dye provided thereon, comprising a step of pasting a substrate and a resin film with an adhesive to produce a laminated resin sheet used as said support.

(10) The process for preparing an image receiving sheet for thermal transfer recording described in (9) wherein the above adhesive is a hot melt or curing type adhesive.

DESCRIPTION OF THE PREFERRED EMBODIMENTS

In the following, the present invention is explained in detail.

Image receiving sheet for thermal transfer recording

The image receiving sheet for thermal transfer recording of the present invention (hereinafter referred to as "image receiving sheet") has a support comprising a laminated resin sheet and an image receiving layer.

A sheet-shaped substrate of the laminated resin sheet is not particularly limited, and there may be used substrates comprising various materials, layer structures and sizes suitably selected depending on the purpose of use. There may be included, for example, various papers such as a paper, a coated paper and a synthetic paper (polypropylene, polystyrene, polyethylene terephthalate, a resin film having a white pigment layer provided on at least one surface thereof, or a composite material in which the material described above and a paper are pasted), various plastic films or sheets such as a vinyl chloride type resin sheet, a styrene type resin sheet, a polyethylene terephthalate base film, a polybutyrene terephthalate base film, a polyethylene naphthalate base film, a polyallylate base film, a polycarbonate base film, a polyether ether ketone base film, a polysulfone base film, a polyether sulfone base film, a polyether imide base film, a polyimide base film and a polyparabanic acid resin film which are used singly or laminated to have two or more layers, films or sheets made of various metals, films or sheets made of various ceramics, or composite materials in which materials selected from the materials described above are combined suitably and laminated. Further, a white pigment, for example, titanium white, magnesium carbonate, zinc oxide, barium sulfate, silica, talc, clay and calcium carbonate may be added to the substrate.

Among the materials described above, the paper and coated paper preferably have a Beck smoothness of 50 seconds or more, more preferably 100 seconds or more, further preferably 200 seconds or more in order to impart smoothness of a surface and adhesion to a resin film described below to be laminated when the paper and the resin film are pasted although it depends on the thickness of the resin film. The above embodiment is preferred since white dots are not generated and adhesion to the resin film is good.

In the present invention, as a preferred sheet-shaped substrate, there may be mentioned a synthetic paper on which a white pigment layer is provided by coating on at least one surface of a polyolefin type, polyester type and/or resin film. Among them, that comprising at least one layer having a porous structure is particularly preferred in the point of sensitivity.

Further, a sheet-shaped substrate mainly composed of a resin selected by the following Group A may be suitably used in the present invention. The resins in Group A have a glass transition temperature (Tg) of 80° C. or higher, and by using these resins, generation of curling during printing can be prevented without thickening the sheet-shaped substrate or a porous resin film having a density of 0.5 to 1.2 g/cm$^3$ described below.

Group A: a polyether ether ketone (PEEK, Tg: 143° C.), a polysulfone (PSF, Tg: 190° C.), a polyether sulfone (PES, Tg: 223° C.), a polyether imide (PEI, Tg 216° C.), a polyimide (PI, Tg: None), a polyphenylene sulfide (PPS, Tg: 90° C.) , a polycarbonate (PC, Tg: 150° C.) , a polyparabanic acid resin (PPA, Tg: 290° C.), a styrene type resin (e.g. polystyrene (PS), Tg: 100° C.) and a vinyl chloride type resin (e.g. a polyvinyl chloride resin (PVC), Tg: 83° C.).

When a laminated product of a resin film having a density in the range of 0.5 to 1.2 g/cm$^3$ described below and a synthetic paper is used, transfer density is higher and less curling is generated as compared with a single resin film which is not a laminated product and has the same thickness as that of the laminated product.

The thickness of the substrate is generally 20 to 1,000 μm, preferably 20 to 500 μm, and may be suitably selected from this range.

In the present invention, it is important to paste a resin film to both sides of the substrate. The resin films to be used are porous resin films having a density in the range of 0.5 to 1.2 g/cm$^3$, preferably 0.8 to 1.1 g/cm$^3$. As a resin which forms these resin films, there may be mentioned a polyolefin type resin, a vinyl chloride type resin, an acrylonitrile-butadiene-styrene (ABS) resin, a polyethylene terephthalate, a polybutylene terephthalate, a polyethylene naphthalate, a polyallylate, a polycarbonate, a polymethyl methacrylate, a modified polyphenylene oxide, a polyether ether ketone, a polysulfone, a polyether sulfone, a polyether imide and a polyimide, which may be used singly or in combination of two or more kinds. By using these resins, a resin film can be prepared by a known method.

In order to make a density of the above resin or resin composition 0.5 to 1.2 g/cm$^3$, a resin itself is made porous. A means of obtaining porosity is not particularly limited, and various methods for obtaining porosity such as a known means for obtaining a porous resin may be applied. As a specific example, there may be mentioned (1) a method of using a commercially available organic foaming agent such as azodicarbonamide, azobisisobutyronitrile (AIBN), dinitrosopentamethylenetetramine, p-toluenesulfonylhydrazide, p,p'-oxybis(benzenesulfonylhydrazide) and barium azodicarboxylate, or an inorganic foaming agent such as sodium bicarbonate and an azide compound, or (2) a method in which a porous resin film having a desired thickness is obtained by adding an incompatible resin or a filler to a resin, extruding the mixture by an extrusion method, then biaxially stretching it to generate fine voids.

The porous resin film of the present invention is preferably obtained by the method (2) described above.

Among them, in the method in which a resin is extruded by an extrusion method and then biaxially stretched to generate fine voids, the void size of the resulting film can be controlled easily to become finer, surface smoothness of a surface on which an image receiving layer is provided in the posterior step becomes better, and mechanical strength such as shock resistance of this film and also an image receiving sheet can be further improved. As a matter of course, after the biaxial stretching, heat treatment (heat fixing treatment) may be carried out suitably in order to secure dimensional stability such as shrink characteristic of the film, if necessary.

When a desired porous resin film is obtained by extrusion molding and biaxial stretching as described above, it is particularly preferred to use at least two resins which are incompatible or hardly compatible with each other (hereinafter the same) as a material for forming porosity. Thus, resins which form porosity can be separated from each other on a microscopic level, and as a result, porosity becomes a microvoid structure more favorably by the above stretching. In the above process, there may be suitably selected a method in which a suitable compatibilizing agent is added to two or more incompatible resins to provide a finer phase separation structure. Thus, by making a finer phase separation structure, a porous resin film having a more uniform and finer porous structure can be formed.

The resin film can be prepared suitably by utilizing a conventional extruder for forming a film. Extrusion by an extruder may be carried out at such a temperature range that a resin is sufficiently fused and also unfavorable reactions such as decomposition are not caused.

The above biaxial stretching can be carried out generally suitably by known apparatus and method which are conventionally used for a resin film. Stretching ratio is generally preferably set so that both vertical and lateral stretching ratios are in the range of about 2.5 to 5.0 times. Stretching temperature may be selected suitably depending on the kind of a resin to be used, a composition of each material for forming the resin and a combination thereof.

In the present invention, even if either method is employed, preferred is a film mainly composed of a polyester type resin such as a polyethylene terephthalate, a polybutylene terephthalate, a polyethylene naphthalate, a polyallylate and a polycarbonate from the standpoint of easiness of production and film formation. Among them, more preferred is a film mainly composed of a polyethylene terephthalate, a polybutylene terephthalate and a polyethylene naphthalate.

In the present invention, various additives may be added to the resin film.

In order to improve whiteness, heat resistance and dimensional stability, it is preferred that the resin film further contains a white fine grain. The white fine grain may be an organic fine grain or an inorganic fine grain, but preferred is an inorganic fine grain from the points of whiteness, heat resistance and heat stability during film formation. The inorganic fine grain is not particularly limited, and various grains may be selected suitably and used. As a representative example, there may be mentioned, for example, a metal oxide such as silica, titanium oxide, aluminum oxide and zinc oxide, a metal salt such as calcium carbonate, magnesium carbonate and barium sulfate, kaolin, clay, talc and a synthetic mica, which are not limitative as a matter of course.

When the inorganic fine grain is added, its content in the resin film is generally preferably 30% by weight or less, more preferably 15% by weight or less. The average grain size of the inorganic fine grain is generally 0.01 to 20 μm, preferably 0.01 to 5 μm. By incorporating the fine grain, an antistatic effect can be also imparted.

In order to improve running stability and antistatic property, it is preferred that the resin film further contains an antistatic agent. Any conventionally known antistatic agent may be used. As a specific example, there may be mentioned a surfactant, for example, a cationic surfactant (e.g. a quaternary ammonium salt and a polyamine derivative), an anionic surfactant (e.g. alkyl phosphate), an amphoteric surfactant or a nonionic surfactant, a conductive resin, and various metals having average grain sizes in the range of 0.01 to 2 μm or oxides and salts thereof.

When the antistatic agent is added, its content in the resin film is generally preferably 20% by weight or less.

Further, additives such as a heat stabilizer, a plasticizer and a fluorescent brightener may be added within the range which does not impair the effect of the present invention. The thickness of the resin film is generally 10 to 250 μm, preferably 20 to 150 μm, more preferably 25 to 100 μm, and may be suitably selected from this range.

A laminated resin film can be prepared by pasting a substrate and a resin film as described above by dry laminating or an adhesive.

In the present invention, pasting is preferably carried out by using an adhesive so that the resin film having a density of 0.5 to 1.2 g/cm$^3$ is not damaged. Said adhesive is more preferably a hot melt or curing type adhesive in order to obtain strength of adhesion to the substrate.

The adhesive may be prepared by, for example, mixing a resin having a low softening point and a tackifier with a thermally fusible substance and/or a thermoplastic substance. Further, an adhesive layer may be prepared by coating an tackifier composition on the surface of a resin layer comprising a thermally fusible substance and/or a thermoplastic substance. Or else, an adhesive layer may be prepared by incorporating a tacky substance encapsulated in a microcapsule by a known method into a resin layer comprising a thermally fusible substance and/or a thermoplastic substance.

As the resin having a low softening point used in the additive, there may be mentioned an ethylenic copolymer such as ethylene-vinyl acetate and ethylene-ethyl acrylate; a polyamide type resin such as Nylon (trademark) and a dimeric acid; a polystyrene type resin such as styrenebutadiene, styrene-isoprene and styrene-ethylene-butylene; a polyester type resin; a polyolefin type resin; a polyvinyl ether type resin; a polymethyl methacrylate type resin; an ionomer resin; a cellulose type resin; a polyurethane type resin; an arylic resin; an epoxy type resin; a melamine type resin; and a vinyl chloride type resin.

As the tackifier, there may be mentioned, for example, an unmodified or modified rosin type tackifier such as a rosin type tackifier, a hydrogenated rosin type tackifier, a rosin maleic acid type tackifier, a polymer rosin type tackifier and a rosin phenol type tackifier, and a terpene type tackifier and a petroleum resin type tackifier, and modified tackifiers thereof.

As the thermally fusible substance which can be contained in the adhesive, there may be mentioned waxes such as carnauba wax, bees wax, paraffin wax, ester wax, montan wax and amide wax, ester gum, a rosin derivative such as a rosin maleic acid resin and a rosin phenol resin, a phenol resin, a ketone resin, an epoxy resin, a diallyl phthalate resin, a terpene resin, an aliphatic hydrocarbon resin, a cyclopentadiene resin, a polyolefin type resin, and a polyolefin oxide such as polyethylene glycol and polypropylene glycol.

When the additive layer is formed, various resins described above may be crosslinked or cured with radioactive ray, heat, humidity or a catalyst by utilizing their reaction sites (if a resin does not have a reaction site, it is imparted to the resin). In that case, a radioactive monomer such as an epoxy or acryl compound, or a crosslinking agent such as isocyanate may be used.

The adhesive layer can be formed by employing, for example, a coating method using a solvent and a hot melt method. The thickness of the adhesive layer thus formed is generally 0.1 to 50 μm, preferably 0.3 to 30 μm.

The laminated resin sheet can be prepared by preparing a coating solution for an adhesive layer comprising components for forming the adhesive layer dispersed or dissolved in a solvent, and coating the coating solution on the surface of the above substrate and/or resin film, followed by drying. Alternatively, it can be also prepared by a laminating method such as dry laminating and hot melt extrusion laminating in which a mixture containing components for forming the adhesive layer is melt extruded, and the mixture is laminated on the surface of the above substrate and/or resin film.

As the solvent to be used for the coating method, there may be mentioned a conventionally known solvent such as water, ethyl alcohol, methyl ethyl ketone, toluene, dioxane, cyclohexanone and methylene chloride.

When the laminating method is employed, a co-extrusion method may be also employed.

The image receiving layer of the image receiving sheet of the present invention is not particularly limited, and may be formed by using various materials and various compositions to have various layer structures depending on the purpose of use. For example, there may be used various materials, compositions and layer structures which are the same as those of a conventional image receiving layer which has been proposed for this kind of image receiving sheet, or suitable improvement may be added thereto.

As a resin to be used in the image receiving layer, there may be mentioned, for example, a polyvinyl chloride resin, a copolymer resin of vinyl chloride and other monomer (e.g. alkyl vinyl ether, allyl glycidyl ether and vinyl propionate), a polyvinilidene chloride type resin, a polyester type resin, an acrylic resin, an epoxy resin, a phenoxy resin, a polyvinyl butyral, a polyvinyl pyrrolidone, a polycarbonate, a polysulfone, a polyallylate, a polyparabanic acid, a cellulose type resin, a styrene type resin, a polyurethane type resin, a polyamide type resin, a urea resin, a polycaprolactone resin and a polyacrylonitrile resin. These resins may be used singly or used in combination by mixing two or more kinds.

The above respective resins may be newly synthesized and used, but commercially available products may be also used. When the image receiving layer is formed, various resins described above may be crosslinked or cured with radioactive ray, heat, humidity or a catalyst by utilizing their reaction sites (if a resin does not have a reaction site, it is imparted to the resin). In that case, a ratioactive monomer such as an epoxy or acryl compound, or a crosslinking agent such as an isocyanate may be used.

Further, when the image receiving layer is formed, in the case where a dye described below which forms a chelate dye image by chelating reaction with a metal ion, a metal ion-containing compound may be contained in the above resin, if necessary.

This kind of the metal ion-containing compound includes those exemplified in U.S. Pat. No. 4,987,049. If this metal ion-containing compound is added, the amount to be added is preferably 5 to 60% by weight, more preferably 10 to 40% by weight based on the image receiving layer.

To the image receiving layer, additives such as a peeling agent, an antioxidant, a UV absorber, a light stabilizer, a fluorescent brightener, a filler (inorganic fine grain and organic fine grain) and a pigment may be added, if necessary. As a sensitizing agent, a plasticizer and a heat-fusible substance may be also added thereto.

The peeling agent improves peeling property between an ink sheet and an image receiving sheet for thermal transfer recording, and in the present invention, it is preferably contained in the outermost layer. As such a peeling agent, there may be mentioned silicone oil (including those called silicone resins); solid waxes such as polyethylene wax, amide wax and Teflon (trade name) powder; and fluorine type and phosphate type surfactants, and among them, silicone oil is preferred. The silicone oil includes silicone oil which is simply added (simple addition type) and silicone oil which is cured or reacted (curing reaction type).

In the case of simple addition type, in order to improve compatibility with the above resin, modified silicone oil (e.g. a polyester-modified silicone resin, a urethane-modified silicone resin and an acryl-modified silicone resin) is preferably used. The amount of the simple addition type silicone oil to be added may change variously depending on the kind, so that it cannot be determined without variation. However, it may be generally 0.1 to 20% by weight, preferably 0.5 to 10% by weight based on the resin used for the image receiving layer.

The curing reaction type silicone oil includes curing reaction type (e.g. silicone oil obtained by reacting and curing an amino-modified silicone oil and an epoxy-modified silicone oil), photocuring type and catalyst curing type. The amount of the curing type silicone oil to be added is preferably 0.5 to 30% by weight of the resin used for the image receiving layer.

Further, a peeling layer may be provided on a part of the surface of the image receiving layer by coating a composition containing the above peeling agent dissolved or dispersed in a suitable solvent, followed by drying.

As the antioxidant, there may be mentioned antioxidants disclosed in Japanese Provisional Patent Publications No. 82785/1984, No. 130735/1985 and No. 127387/1989, and known compounds which can improve image durability of image recording materials such as photographs and others.

As the UV absorber and the light stabilizer, there may be mentioned compounds disclosed in Japanese Provisional Patent Publications No. 158287/1984, No. 74686/1988, No. 145089/1988, No. 196292/1984, No. 229594/1987, No. 122596/1988, No. 283595/1986 and No. 204788/1989, and known compounds which can improve image durability of image recording materials such as photographs and others.

As the fluorescent brightener, there may be mentioned fluorescent brighteners disclosed in Japanese Provisional Patent Publications No. 237693/1986, No. 122596/1988 and No. 147166/1988, and known compounds which can improve image durability of image recording materials such as photographs and others.

As the filler, there may be mentioned an inorganic grain and an organic grain. The inorganic grain may include silica gel, calcium carbonate, titanium oxide, acidic clay, active clay and alumina, and the organic grain may include resin grains such as a fluorine resin grain, a guanamine resin grain, an acryl resin grain and a silicone resin grain. These inorganic and organic resin grains are preferably added in amounts of 0 to 30% by weight based on the image receiving layer although the amount may vary depending on specific gravity.

As a representative example of the pigment, there may be mentioned titanium white, calcium carbonate, zinc oxide, barium sulfate, silica, talc, clay, kaolin, active clay and acidic clay.

As the plasticizer, there may be mentioned phthalates, trimellitates, adipates, other saturated or unsaturated carboxylates, citrates, epoxidized soybean oil, epoxidized linseed oil, epoxystearic acid epoxides, orthophosphates, phosphites and glycol esters.

As the heat-fusible substance, there may be mentioned monomolecular compounds represented by alcohols such as terpineol, menthol, 1,4-cyclohexanediol and phenol, amides such as acetamide and benzamide, esters such as coumarin and benzyl cinnamate, ethers such as diphenyl ether and crown ether, ketones such as camphor and p-methylacetophenone, aldehydes such as vanillin and dimethoxybenzaidehyde, hydrocarbons such as norbornene and stilbene, a higher aliphatic acid such as margaric acid, a higher alcohol such as eicosanol, a higher aliphatic acid ester such as cetyl palmirate, a higher aliphatic acid amide such as stearic acid amide, and a higher amine such as behenylamine; and polymer compounds represented by waxes such as carnauba wax, bees wax, paraffin wax, ester wax, montan wax and amide wax, ester gum, a rosin derivative such as a rosin maleic acid resin and a rosin phenol resin, a phenol resin, a ketone resin, an epoxy resin, a diallyl phthalate resin, a terpene resin, an aliphatic hydrocarbon resin, a cyclopentadiene resin, a polyolefin type resin, and a polyolefin oxide such as polyethylene glycol and polypropylene glycol.

In the present invention, the melting point or softening point of the above thermally fusible substance is preferably 10° to 150° C.

In the present invention, the total amount of the additives to be added is generally preferably selected from the range of 0.1 to 40% by weight based on the resin to be used for the image receiving layer.

The thickness of the image receiving layer is generally suitably selected from the range of 3 to 30 μm, preferably 5 to 20 μm. The image receiving layer may be a single layer or may have a multilayer structure comprising two or more layers having the same or different compositions, if necessary.

Further, between the image receiving layer and the laminated resin film, an intermediate layer (subbing layer) may be provided for the purpose of imparting characteristics such as adhesion property. Also, on the surface of the image receiving layer, an overcoat layer may be laminated for the purpose of preventing fusing between an ink sheet and an image receiving sheet. When these intermediate layer and overcoat layer are provided, each thickness is generally suitably selected from the range of 0.1 to 20 μm.

Preparation of image receiving sheet

The image receiving sheet of the present invention can be obtained basically by providing the above image receiving layer on one surface of the laminated resin film:

The image receiving layer can be formed by a coating method in which a coating solution for forming the image receiving layer-is prepared by dispersing or dissolving components for forming said layer in a solvent is prepared, and the coating solution is coated on the surface of the laminated resin film, followed by drying, or a laminating method in which a mixture containing components for forming the image receiving layer is melt extruded, and the mixture is laminated on the surface of the laminated resin film.

As the solvent to be used for the coating method, there may be mentioned, for example, water, alcohols (e.g. ethanol and propanol), cellosolves (e.g. methyl cellosolve and ethyl cellosolve), aromatics (e.g. toluene, xylene and chlorobenzene), ketones (e.g. acetone and methyl ethyl ketone), an ester type solvent (e.g. ethyl acetate and butyl acetate), ethers (e.g. tetrahydrofuran and dioxane) and a chlorine type solvent (e.g. methylene chloride, chloroform and trichloroethylene).

A coating method by gravure roll, an extrusion coating method, a wire bar coating method and a roll coating method which have been conventionally known may be employed for coating. After the coating, drying is carried out suitably to form an image receiving layer having a desired dried film thickness.

The image receiving layer is not limited to a single layer structure, and may have a structure of two or more layers. Further, the image receiving layer may be formed on the whole surface of the laminated resin film, or may be formed on a part of the surface, if necessary.

Ink sheet for thermal transfer recording

The ink sheet for thermal transfer recording (hereinafter referred to as "ink sheet") can be formed basically by laminating an ink layer on a support.

The support for the ink sheet may be any support so long as dimensional stability is good and it can stand heat during recording with a thermal head, and there may be used a tissue paper such as a condenser paper and a glassine paper, and a heat-resistant plastic film such as a polyethylene terephthalate, a polyethylene naphthalate, a polyamide, a polyimide, a polycarbonate, a polysulfone, a polyvinyl alcohol cellophane and a polystyrene.

The thickness of the support is preferably 2 to 10 μm.

The shape of the support is not particularly limited, and may have any desired shape, for example, a wide sheet or film and a slender tape or card.

When transfer to the image receiving sheet is carried out by the thermal diffusion transfer system, the ink layer contains a thermally diffusible dye and a binder as indispensable components.

As the thermally diffusible dye, there may be mentioned a cyan dye, a magenta dye and a yellow dye.

As the cyan dye, there may be mentioned naphthoquinone type dyes, anthraquinone dyes and azomethine type dyes disclosed in Japanese Provisional Patent Publications No. 78896/1984, No. 227948/1984, No. 24966/1985, No. 53563/1985, No. 130735/1985, No. 131292/1985, No. 239289/1985, No. 19396/1986, No. 22993/1986, No. 31292/1986, No. 31467/1986, No. 35994/1986, No. 49893/1986, No. 148269/1986, No. 191191/1987, No. 91288/1988, No. 91287/1988 and No. 290793/1988.

As the magenta dye, there may be mentioned anthraquinone type dyes, azo dyes and azomethine type dyes disclosed in Japanese Provisional Patent Publications No. 78896/1984, No. 30392/1985, No. 30394/1985, No. 253595/1985, No. 262190/1986, No. 5992/1988, No. 205288/1988, No. 159/1989 and No. 63194/1989.

As the yellow dye, there may be mentioned roethine type dyes, azo type dyes, quinophthalone type dyes and anthraisothiazole type dyes disclosed in Japanese Provisional Patent Publications No. 78896/1984, No. 27594/1985, No. 31560/1985, No. 53565/1985, No. 12394/1986 and No. 122594/1988.

Among these thermally diffusible dyes, particularly preferred are an azomethine dye obtained by the coupling reaction of a compound having an open or closed type active methylene group with an oxidized product of a p-phenylenediamine derivative or an oxidized product of a p-aminophenol derivative, or an indoaniline dye obtained by the coupling reaction of the compound with phenol or an oxidized product of a naphthol derivative and a p-phenylenediamine derivative or an oxidized product of a p-aminophenol derivative.

The thermally diffusible dye to be contained in the above ink layer may be any of a yellow dye, a magenta dye or a cyan dye so long as an image to be formed is monochromatic. When a metal ion-containing compound is contained in the image receiving layer of the image receiving sheet, the thermally diffusible dye is preferably a dye compound which can form a chelate with the above metal ion-containing compound. The dye compound which can form a chelate with the metal ion-containing compound may be selected suitably from various known compounds. There may be mentioned specifically a cyan image forming dye (hereinafter referred to as "cyan dye"), a magenta image forming dye (hereinafter referred to as "magenta dye") and a yellow image forming dye (hereinafter referred to as "yellow dye") disclosed in Japanese Provisional Patent Publications No. 78893/1984, No. 109349/1984, No. 213303/1990, No. 214719/1990 and No. 203742/1990.

Among these dyes, it is preferred to use a dye compound which can form at least bidentate chelate with the above metal ion-containing compound. As such a dye, there may be mentioned, for example, a dye represented by the following formula (I).

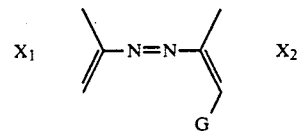

(I)

wherein $X_1$ represents a group of atoms necessary for completing an aromatic carbon ring or heterocyclic ring in which at least one ring comprises 5 to 7 atoms, and at least one position adjacent to carbon atom bonded to an azo bonding is nitrogen atom or carbon atom substituted by a chelating group; $X_2$ represents an aromatic heterocyclic ring in which at least one ring comprises 5 to 7 atoms or aromatic carbon ring; and G represents a chelating group.

Even if either dye compound is employed, at least two kinds of the above three kinds of dyes or other sublimable dyes may be contained depending on the color tone of an image to be formed.

The amounts of these thermally diffusible dyes are generally 5 to 80% by weight, preferably 20 to 70% by weight of a composition for forming the ink layer.

As the binder of the ink layer, there may be mentioned a cellulose addition compound, a cellulose type resin such as cellulose ester and cellulose ether, a polyvinyl alcohol, a polyvinyl acetal type resin such as polyvinyl formal, polyvinyl acetoacetal and polyvinyl butyral, a polyvinyl pyrrolidone, a polyvinyl acetate, a polyacrylamide, a styrene type resin, a polyolefin type resin such as poly(meth)acrylate type, poly(meth)acrylic acid(ester) and (meth)acrylic acid(ester) copolymers, a rubber type resin, an ionomer resin and a polyester type resin.

The respective binders may be used singly or in combination of two or more kinds. The weight ratio of the binder to the above thermally diffusible dye is preferably in the range of 1:20 to 8:2, particularly preferably 2:8 to 7:3.

Further, various additives may be suitably added to the ink layer. As the additives, there may be mentioned a peelable compound such as a silicone resin, a silicone oil (included curing reaction type), a silicone-modified resin, a fluorine resin, a surfactants and waxes, a filler such as metal fine powder, silica gel, metal oxide, carbon black and resin fine powder, and a curing agent which can react with a binder component (e.g. isocyanates and radioactive compounds such as acryls and epoxies).

As the additive, there may be additionally mentioned a thermally fusible substance which accelerates transfer, for example, a wax and compounds such as higher aliphatic acid ester disclosed in Japanese Provisional Patent Publication No. 106997/1984.

The ink sheet is not limited to a two layer structure comprising a support and an ink layer, and other layers may be formed. For example, for the purpose of preventing fusing with the image receiving sheet and print through (blocking) of the thermally diffusible dye, an overcoat layer may be provided on the surface of the ink layer.

Further, the support may have a subbing layer for the purposes of improving adhesiveness to the binder and preventing transfer and dyeing of the dye onto the support side. On the back surface (opposite side to the ink layer) of the support, a backing layer may be provided for the purpose of preventing fusing and sticking of a head to the support and wrinkling of the ink sheet.

The thicknesses of these overcoat layer, subbing layer and backing layer are each generally 0.1 to 1 μm.

Preparation of ink sheet

The ink sheet can be formed by preparing a coating solution for forming the ink layer comprising the above respective components for forming the ink layer dispersed or dissolved in a solvent, and coating the coating solution on the surface of the support, followed by drying.

At least one of the binders described above is used by dissolving it in a solvent or dispersing it in a latex state.

As the solvent, there may be mentioned water, ethanol, tetrahydrofuran, methyl ethyl ketone, toluene, xylene, chloroform, dioxane, acetone, cyclohexane and butyl acetate.

A frame sequential separate coating method by gravure roll, an extrusion coating method, a wire bar coating method and a roll coating method which have been conventionally known may be employed for coating.

The ink layer may be formed on the whole surface or a part of the surface of the support as a layer containing monochromatic thermally diffusible dye, or a yellow ink layer containing a binder and a yellow dye, a magenta ink layer containing a binder and a magenta dye, and a cyan ink layer containing a binder and a cyan dye may be formed on the whole surface of a part of the surface of the support in the plane direction constantly and repeatedly.

In addition to the above three ink layers arranged in the plane direction, a black ink layer containing a black image forming substance may be formed. Either diffusion transfer type or fusion transfer type black ink layer can provide a sharp image.

The film thickness of the ink layer thus formed is generally 0.2 to 10 μm, preferably 0.3 to 3 μm.

On the ink sheet, perforation may be formed, or a detection mark to detect a position of a district different in color hue may be provided for convenience of usage.

Image formation

In order to form an image, the ink layer of the ink sheet is superposed on the image receiving layer of the image receiving sheet, and heat energy is applied imagewisely to the interface of the ink layer and the image receiving layer. The thermally diffusible dye in the ink layer is vaporized or sublimated in an amount corresponding to the heat energy applied, and transferred to and received by the image receiving layer side, whereby a dye image is formed on the image receiving layer. When the image receiving sheet having an image receiving layer to which the above metal ion-containing compound is added is used, a dye image is formed as a chelate image.

As a heat source for giving heat energy, a thermal head is generally used, and in addition, known heat sources such as laser beam, an infrared flash lamp and a hot pen may be used.

When a thermal head is used as a heat source, by changing voltage or pulse width applied to the thermal head, applied heat energy may be changed continuously or stepwisely.

When laser beam is used as a heat source, by changing dose or irradiated area of laser beam, applied heat energy may be changed. In this case, in order to absorb laser, beam easily, a laser beam absorbing material (e.g. carbon black and a near infrared ray absorbing substance in the case of semiconducting laser beam) may preferably exist in the ink layer or in the vicinity of the ink layer. When laser beam is used, the ink sheet and the image receiving sheet may be desirably contacted sufficiently.

By using a dot generator having an acoustic optical element therein, heat energy corresponding to a dot size may be also applied.

When an infrared flash lamp is used as a heat source, heating may be carried out through a colored layer such as a black layer similarly as in the case of using laser beam. Alternatively, heating may be carried out through a pattern continuously expressing a shade of an image such as black or a dot pattern. Or else, heating may be carried out by using a colored layer such as a layer having a whole black surface and a negative pattern corresponding to a negative of the above pattern in combination.

The heat energy may be applied from a ink sheet side, an image receiving sheet side or both sides. However, if it is preferential to use heat energy effectively, the heat energy is desirably applied from an ink sheet side.

By the thermal transfer recording as described above, a monochromatic image can be recorded on the image receiving layer of the image receiving sheet. According to the following method, a color image like a color photograph comprising combinations of respective colors can be also obtained.

For example, when thermal transfer of each color is carried out by changing yellow, magenta, cyan and if necessary, black ink sheets successively, a color image like a color photograph comprising combinations of the respective colors can be obtained.

Further, in place of using ink sheets of the respective colors as described above, there may be effectively used a method in which an ink sheet having areas previously coated in the respective colors formed thereon. That is, a yellow color image is thermally transferred by using a yellow area, and then a magenta color image is thermally transferred by using a magenta area. By repeating the above operation, a yellow, magenta, cyan and if necessary, black color images are thermally transferred successively.

According to this method, a color image like a color photograph can be obtained, and it is further convenient that this method has an advantage that changing of ink sheets as described above is not required.

Further, after an image is formed according to these methods, for the purpose of improving image storage stability, heat treatment may be carried out by the above method. For example, heat treatment may be carried out by a thermal head on the whole surface on which an image is formed, by using a portion of the ink sheet on which the ink layer is not provided, or heat treatment may be carried out by a heat roll. When a near IR absorber is contained, a surface on which an image is formed may be exposed by using an infrared flash lamp.

In either case, a heating means is not limited. However, heating is carried out for the purpose of further diffusing a dye in the image receiving layer, so that it is effective and preferred to heat from a support side of the image receiving layer.

EXAMPLES

The present invention is described in detail by referring to Examples, but the embodiments of the present invention are not limited thereto. In the following, "part" means "part by weight", and the density (g/cm$^3$) of a resin film is an average value of weights per unit volume of 5 samples collected from optional portions.

EXAMPLE 1

Preparation of image receiving sheet

On both surfaces of a polypropylene type synthetic paper Yupo FPG#110 (trade name, produced by Oji Yuka Goseishi K.K.) having a thickness of 110 μm, which was used as a substrate, a coating solution for forming an abesire layer having the following composition was coated and dried to form an adhesive layer having a thickness of 5 μm.

| Coating solution for forming adhesive layer | |
|---|---|
| Polyester type resin Vyron 200 (trade name, produced by Toyobo K.K.) | 10 parts |
| Methyl ethyl ketone | 80 parts |
| Cyclohexanone | 10 parts |

Subsequently, a white polyethylene terephthalate film E60 (trade name, produced by Toray K.K.) having a thickness of 50 μm and a density of 0.8 g/cm$^3$ was superposed on both surfaces of the adhesive layer, and the film and the adhesive layer were so heated and contacted by a heat roll that bubbles were not generated, whereby a laminated resin sheet was obtained.

Next, a coating solution for forming an image receiving layer comprising the following composition was prepared.

| Coating solution for forming image receiving layer | |
|---|---|
| Polyvinyl chloride resin TK-600 (trade name, produced by Shinetsu Kagaku Kogyo K.K.) | 5 parts |
| Vinyl chloride type resin Laroflex MP25 (trade name, produced by BASF Co.) | 4.5 parts |
| Polyester-modified silicone resin X-24-8300 (trade name, produced by Shinetsu Kagaku Kogyo K.K.) | 0.5 part |
| Methyl ethyl ketone | 80 parts |
| Cyclohexanone | 10 parts |

The coating solution for forming an image receiving layer was coated on one surface of the above laminated resin sheet, and dried to form an image receiving layer having a thickness of 10 μm, whereby an image receiving sheet was obtained.

Preparation of ink sheet

On the surface of a polyethylene terephthalate film Lumiler F53N (trade name, produced by Toray K.K.) having a thickness of 6 μm subjected to corona treatment, which was used as a support, a coating solution for forming an ink layer having the following composition was so coated according to a wire bar coating method that the thickness after drying becomes 1 μm, and dried, and also on the back surface not subjected to corona treatment, a nitrocellulose solution containing 80% by weight of a silicone resin Dai Allomer SP-712 (trade name, produced by Dainichi Seika K.K.) was so coated according to a wire bar coating method that the thickness after drying becomes 0.5 μm, and dried to give a back surface coating, whereby an ink sheet was obtained.

| Coating solution for forming ink layer | |
|---|---|
| Thermally diffusible dye Kayaset Blue 714 (trade name, produced by Nihon Kayaku K.K.) | 4.0 parts |
| Polyvinyl butyral S-Lec BX-1 (trade name, produced by Sekisui Kagaku K.K.) | 5.0 parts |
| Methyl ethyl ketone | 81 parts |
| Cyclohexanone | 10 parts |

Image formation

The ink sheet and image receiving sheet thus obtained were so superposed that the ink layer surface of the former was brought into contact with the image receiving layer surface of the latter, and an image was recorded by using a thermal head from a support side of the ink sheet under the following conditions.

Linear density of horizontal scanning and vertical scanning: 8 dot/mm Electric powder of recording: 0.6 W/dot Heating time of thermal head: heating time was controlled stepwisely between 20 msec (applied energy: about $11.2\times10^{-3}$ J) and 2 msec (applied energy: about $1.12\times10^{-3}$ J).

According to the following methods, curling, bleeding, transfer sensitivity, transfer density and presence or absense of white dots were evaluated by using standards described below. The results are shown in Table 1.

<Curling>

Curling was measured by a curling gage, and represented by its reciprocal of a radius of curvature turned into meter (0 to 0.5 in all samples before printing).

◎... $X<0.5$
○... $0.5 \leqq X < 1$
Δ... $1 \leqq X < 2$
X ... $2 \leqq X$

<Transfer density>

The maximum selection density (OD value) of the image was measured by an optical densitometer (the maximum value of applied energy).

◎... $OD > 2.5$
○... $2.5 \geqq OD > 2.0$
Δ... $2.0 \geqq OD \geqq 1.7$
X ... $1.7 > OD$ <Bleeding preventive property of dye>

After the image receiving sheet on which the image was recorded was left to stand at 60° C. for one week, bleeding degree was measured with visual observation and judged by a microdensitometer.

○... Almost no bleeding was observed.
Δ... Slight bleeding was observed.
X ... Bleeding was observed clearly.

<Transfer sensitivity>

Applied energy (E) which gave a reflection density of 1.0 was measured and judged by an optical densitometer.

◎... $E \leqq 4.8\times10^{-3}$ J
○... $4.8\times10^{-3}$ J $< E \leqq 5.2\times10^{-3}$ J
Δ... $5.2\times10^{-3}$ J $< E \leqq 5.6\times10^{-3}$ J
X ... $E > 5.6\times10^{-3}$ J <Presence or absence of white dots>

Degree of white dots of the transferred image was judged by visual observation.

○... Almost no white dot was observed.
Δ... White dots were slightly observed.
X ... White dots were observed.

EXAMPLE 2

On a white polyethylene terephthalate film W900J (trade name, produced by Diafoil K.K.) having a thickness of 38 μm and a density of 10 g/cm³ which was used as a resin film, a coating solution for forming an adhesive layer having the following composition was so coated according to a wire bar coating method that the thickness after drying became 5 μm, and dried.

| Coating solution for forming adhesive layer | |
|---|---|
| Vinyl chloride type resin VYES-4 (trade | 9 parts |

-continued

| Coating solution for forming adhesive layer | |
|---|---|
| produced by Union Carbide Co.) | |
| Curing agent Colonate L (trade name, produced by Nippon Polyurethane Kogyo K.K.) | 1 part |
| Methyl ethyl ketone | 80 parts |
| Cyclohexanone | 10 parts |

As a substrate, a polyester type synthetic paper Crisper G1212 (trade name, produced by Toyobo K.K.) having a thickness of 100 μm was used, and a resin film on which the above adhesive layer was provided was superposed on both surfaces of the synthetic paper. The resin film and the synthetic paper were so heated and contacted by a laminator that bubbles were not generated, and then the adhesive layer was cured by heating at 100° C. for 1 hour to obtain a laminated resin film.

On one surface of the laminated resin film obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated in the same manner as in Example 1. The results are shown in Table 1.

EXAMPLE 3

On a white polyethylene terephthalate film E60 (trade name, produced by Toray K.K.) having a thickness of 50 μm and a density of 0.8 g/cm³, which was used as a resin film, a coating solution for forming an adhesive layer having the following composition prepared and dispersed by a ball mill was so coated according to a wire bar coating method that the thickness after drying became 5 μm, and dried.

| Coating solution for forming adhesive layer | |
|---|---|
| Ethylene-vinyl acetate copolymer Evaflex EV210 (trade name, produced by Mitsui Dupont Polychemical K.K.) | 4 parts |
| Rosin ester Ester Gum 105 (trade name, produced by Arakawa Kagaku K.K.) | 5 parts |
| Polyethylene wax Mitsui Hi-Wax 100P (trade name, produced by Mitsui Sekiyu Kagaku K.K.) | 1 part |
| Methyl ethyl ketone | 40 parts |
| Toluene | 40 parts |
| Cyclohexanone | 10 parts |

As a substrate, a paper of fine quality having a thickness of 80 μm and a Beck smoothness of 250 seconds was used, and a resin film on which the above adhesive layer was provided was superposed on both surfaces of the substrate. The resin film and the substrate were so heated and contacted by a heat roll that bubbles were not generated to obtain a laminated resin film.

On one surface of the laminated resin film obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 4

On a white polyethylene terephthalate film W900J (trade name, produced by Diafoil K.K.) having a thickness of 50 μm and a density of 1.0 g/cm$^3$, which was used as a resin film, a coating solution for forming an adhesive layer having the following composition was so coated according to a wire bar coating method that the thickness after drying became 5 μm, and dried.

| Coating solution for forming adhesive layer | |
|---|---|
| Vinyl chloride type resin VYES-4 (trade name, produced by Union Carbide Co.) | 5 parts |
| Vinyl chloride type resin VYHH (trade name, produced by Union Carbide Co.) | 4 parts |
| Curing agent Colonate L (trade name, produced by Nippon Polyurethane Kogyo K.K.) | 1 part |
| Methyl ethyl ketone | 80 parts |
| Cyclohexanone | 10 parts |

As a substrate, a polypropylene type synthetic paper Yupo TPG#60 (trade name, produced by Oji Yuka Goseishi K.K.) having a thickness of 60 μm was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin film.

On one surface of the laminated resin film obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 5

On a white polyethylene terephthalate film Crisper G2115 (trade name, produced by Toyoho K.K.) having a thickness of 75 μm and a density of 11 g/cm$^3$ which was used as a resin film, a coating solution for forming an adhesive layer having the following composition was so coated according to a wire bar coating method that the thickness after drying became 5 μm, and dried.

| Coating solution for forming adhesive layer | |
|---|---|
| Polyurethane resin Takelak A-367H (trade name, produced by Takeda Yakuhin Kogyo K.K.) | 7.5 parts |
| Curing agent Takenate A-7 (trade name, produced by Takeda Yakuhin Kogyo K.K.) | 2.5 parts |
| Methyl ethyl ketone | 80 parts |
| Cyclohexanone | 10 parts |

As a substrate, a polyvinyl chloride resin sheet Sumilite VSS-HT-410 (trade name, produced by Sumitomo Bakelite Company Limited) having a thickness of 350 μm was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 6

On a polyethylene terephthalate film W900J (trade name, produced by Diafoil K.K.) having a thickness of 100 μm and a density of 1.0 g/cm$^3$ and containing white inorganic grains, which was used as a resin film, a coating solution for forming an adhesive layer having the following composition prepared and dispersed by a ball mill was so coated according to a wire bar coating method that the thickness after drying became 5 μm, and dried.

| Coating solution for forming adhesive layer | |
|---|---|
| Epoxy resin Epikote 1001 (trade name, produced by Yuka Shell Epoxy K.K.) | 5 parts |
| Curing agent Epomate B-002 (trade name, produced by Yuka Shell Epoxy K.K.) | 5 parts |
| Methyl ethyl ketone | 80 parts |
| Cyclohexanone | 10 parts |

As a substrate, a synthetic paper Peachcoat WE-110 (trade name, produced by Nisshinbo K.K.) having a thickness of 110 μm was used, and a resin film on which the above adhesive layer was provided was superposed on both surfaces of the substrate. The resin film and the substrate were so heated and contacted by a heat roll that bubbles were not generated to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 7

On a white polyethylene terephthalate film W900J (trade name, produced by Diafoil K.K.) having a thickness of 38 μm and a density of 10 g/cm$^3$ which was used as a resin film, a coating solution for forming an adhesive layer having the following composition was so coated according to a wire bar coating method that the thickness after drying became 5 μm, and dried.

| Coating solution for forming adhesive layer | |
|---|---|
| Vinyl chloride type resin VYES-4 (trade name, produced by Union Carbide Co.) | 7 parts |
| Curing agent Colonate L (trade name, produced by Nippon Polyurethane Kogyo K.K.) | 3 parts |
| Methyl ethyl ketone | 80 parts |
| Cyclohexanone | 10 parts |

As a substrate, a white polyethylene terephthalate film W900J (trade name, produced by Diafoil K.K.) having a thickness of 100 μm and a density of 1.0 g/cm$^3$ was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLES 8 TO 14

Image receiving sheets were prepared in the same manner as in Example 7 except for changing the substrate to the following films, respectively. By using the image receiving sheets obtained and the ink sheet of Example 1, images were formed and evaluated. The results are shown in Table 1.

EXAMPLE 8

PEEK film Sumilite FS-1100 (trade name, produced by Sumitomo Bakelite Company Limited) having a thickness of 100 μm

EXAMPLE 9

PSF film Sumilite FS-1200 (trade name, produced by Sumitomo Bakelite Company Limited) having a thickness of 100 μm

EXAMPLE 10

PES film Sumilite FS-1300 (trade name, produced by Sumitomo Bakelite Company Limited) having a thickness of 100 μm

EXAMPLE 11

PEI film Sumilite FS-1400 (trade name, produced by Sumitomo Bakelite Company Limited) having a thickness of 100 μm

EXAMPLE 12

PI film Kapton 500H (trade name, produced by Toray Du Pont Co.) having a thickness of 125 μm

EXAMPLE 13

PPS film Toray Polyphenylene Sulfide Film (trade name, produced by Toray K.K.) having a thickness of 100 μm

EXAMPLE 14

PC film Macrohole KL3-1011 (trade name, produced by Bayer Japan K.K.) having a thickness of 100 μm

EXAMPLE 15

After 85 parts of polyethylene terephthalate chips having an intrinsic viscosity of 0.68 and 15 parts of crystalline polypropylene having a melt flow index of 10 g/10 min were kneaded and stirred sufficiently at 290° C., an extruder was charged with the resulting mixture. The mixture was extruded through a die for forming a film to obtain a film. Next, the film was stretched in the vertical direction in a tender oven with a tensile tension of 3.2:1 and then stretched in the lateral direction with a tensile tension of 3.1:1. Subsequently, the biaxially stretched film was heat-set in a tender oven heated at 230° C. The resin film thus obtained was a porous film having a thickness of 50 μm and a density of 0.85 g/cm$^3$.

On the resin film thus obtained, a coating solution for forming an adhesive layer having the following composition was so coated according to a wire bar coating method that the thickness after drying became 5 μm, and dried.

| Coating solution for forming adhesive layer | |
|---|---|
| Polyester type resin Vyron 103 (trade name, produced by Toyobo K.K.) | 8 parts |
| Curing agent Colonate L (trade name, produced by Nippon Polyurethane Kogyo K.K.) | 2 parts |
| Methyl ethyl ketone | 80 parts |
| Cyclohexanone | 10 parts |

As a substrate, the polypropylene type synthetic paper used in Example 1 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 16

After 82 parts of polyethylene terephthalate chips having an intrinsic viscosity of 0.68, 15 parts of crystalline polypropylene having a melt flow index of 10 g/10 min and 3 parts of white titanium oxide fine grains Titanium Dioxide P25 (trade name, produced by Nippon Aerojell K.K.) having an average grain size of 0.02 μm were kneaded and stirred sufficiently at 290° C., an extruder was charged with the resulting mixture. The mixture was extruded through a die for forming a film to obtain a film. Next, the film was stretched in the vertical direction in a tender oven with a tensile tension of 3.2:1 and then stretched in the lateral direction with a tensile tension of 3.2:1. Subsequently, the biaxially stretched film was heat-set in a tender oven heated at 230° C. The resin film thus obtained was a porous film having a thickness of 50 μm and a density of 0.95 g/cm$^3$.

On the resin film thus obtained, a coating solution for forming an adhesive layer having the following composition was so coated according to a wire bar coating method that the thickness after drying became 5 μm, and dried.

| Coating solution for forming adhesive layer | |
|---|---|
| Polyester type resin Vyron 103 (trade name, produced by Toyobo K.K.) | 7 parts |
| Curing agent Colonate L (trade name, produced by Nippon Polyurethane Kogyo K.K.) | 3 parts |
| Methyl ethyl ketone | 80 parts |
| Cyclohexanone | 10 parts |

As a substrate, the paper of fine quality used in Example 3 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 17

After 82 parts of polyethylene terephthalate chips having an intrinsic viscosity of 0.68, 12 parts of crystalline polypropylene having a melt flow index of 10 g/10 rain, 3 parts of white titanium oxide fine grains Titanium Dioxide P25 (trade name, produced by Nippon Aerojell K.K.) having an average grain size of 0.02 μm and a white metal oxide type antistatic agent White Conductive Powder W-1 (trade name, produced by Mitsubishi Material K.K.) having an average grain size of 0.02 μm were kneaded and stirred sufficiently at 290° C., an extruder was charged with the resulting mixture. The mixture was extruded through a die for forming a film to obtain a film. Next, the film was stretched in the vertical direction in a tender oven with a tensile tension of 3.3:1 and then stretched in the lateral direction with a tensile tension of 3.4:1. Subsequently, the biaxially stretched film was heat-set in a tender oven heated at 230° C. The resin film thus obtained was a porous film having a thickness of 50 μm and a density of 1.00 g/cm$^3$.

On the resin film thus obtained, a coating solution for forming an adhesive layer having the following composition was so coated according to a wire bar coating method that the thickness after drying became 5 μm, and dried.

| Coating solution for forming adhesive layer | |
|---|---|
| Polyester type resin Vyron 200 (trade name, produced by Toyobo K.K.) | 8 parts |
| Curing agent Colonate L (trade name, produced by Nippon Polyurethane Kogyo K.K.) | 2 parts |
| Methyl ethyl ketone | 80 parts |
| Cyclohexanone | 10 parts |

As a substrate, the polypropylene type synthetic paper used in Example 4 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 18

After 85 parts of polyethylene terephthalate Bellpet DFG-1 (trade name, produced by Kanegafuchi Kagaku Kogyo K.K.), 10 parts of modified polyphenylene oxide Nolyl S100J (trade name, produced by Engineering Plastic K.K.) and 5 parts of a white inorganic antistatic agent TYPE-II (trade name, produced by Mitsui Kinzoku K.K.) having an average grain size of 1.0 μm, which were used as materials for forming a resin film, were kneaded and stirred sufficiently at 280° C., an extruder was charged with the resulting mixture. The mixture was extruded through a die for forming a film to obtain a film. Next, the film was stretched in the vertical direction in a tender oven with a tensile tension of 3.2:1 and then stretched in the lateral direction with a tensile tension of 3.5:1. Subsequently, the biaxially stretched film was heat-set in a tender oven heated at 200° C. The resin film thus obtained was a porous film having a thickness of 50 μm and a density of 1.1 g/cm$^3$.

On the resin film thus obtained, a coating solution for forming an adhesive layer having the following composition was so coated according to a wire bar coating method that the thickness after drying became 5 μm, and dried.

| Coating solution for forming adhesive layer | |
|---|---|
| Polyester type resin Vyron 103 (trade name, produced by Toyobo K.K.) | 6 parts |
| Curing agent Colonate L (trade name, produced by Nippon Polyurethane Kogyo K.K.) | 4 parts |
| Methyl ethyl ketone | 80 parts |
| Cyclohexanone | 10 parts |

As a substrate, the polyvinyl chloride resin sheet used in Example 5 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 19

After 82 parts of polyethylene terephthalate Julanex 2002 (trade name, produced by Polyplastic K.K.), 10 parts of modified polyphenylene oxide Nolyl S100J (trade name, produced by Engineering Plastic K.K.), 5 parts of a white inorganic antistatic agent TYPE-II (trade name, produced by Mitsui Kinzoku K.K.) having an average grain size of 1.0 μm and 3 parts of a resin modifier Reseda GP-500 (trade name, produced by Toa Gosei K.K.), which were used as materials for forming a resin film, were kneaded and stirred sufficiently at 270° C., an extruder was charged with the resulting mixture. The mixture was extruded through a die for forming a film to obtain a film. Next, the film was stretched in the vertical direction in a tender oven with a tensile tension of 3.0:1 and then stretched in the lateral direction with a tensile tension of 3.3:1. Subsequently, the biaxially stretched film was heat-set in a tender oven heated at 160° C. The resin film thus obtained was a porous film having a thickness of 30 μm and a density of 0.9 g/cm$^3$.

On the resin film thus obtained, a coating solution for forming an adhesive layer having the following composition was so coated according to a wire bar coating method that the thickness after drying became 2 μm, and dried.

| Coating solution for forming adhesive layer | |
|---|---|
| Vinyl chloride type resin VAGH (trade name, produced by Union Carbide Co.) | 8 parts |
| Curing agent Colonate L (trade name, produced by Nippon Polyurethane Kogyo K.K.) | 2 parts |
| Methyl ethyl ketone | 80 parts |
| Cyclohexanone | 10 parts |

As a substrate, the synthetic paper used in Example 6 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 1 hour to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 20

After 80 parts of polyethylene terephthalate Bellpet DFG-1 (trade name, produced by Kanegafuchi Kagaku Kogyo K.K.), 15 parts of Polybutylene terephthalate Julanex 2002 (trade name, produced by Polyplastic K.K.), 3 parts of white titanium oxide fine grains Titanium Dioxide P25 (trade name, produced by Nippon Aerojell K.K.) having an average grain size of 0.02 μm and 2 parts of white synthetic mica Synthetic Mica MK-100 (trade name, produced by Co-op Chemical Co., Ltd.), which were used as materials for forming a resin film, were kneaded and stirred sufficiently at 280° C., an extruder was charged with the resulting mixture. The mixture was extruded through a die for forming a film to obtain a film. Next, the film was stretched in the vertical direction in a tender oven with a tensile tension of 3.5:1 and then stretched in the lateral direction with a tensile tension of 3.0:1. Subsequently, the biaxially stretched film was heat-set in a tender oven heated at 170° C. The resin film thus obtained was a porous film having a thickness of 50 μm and a density of 0.90 g/cm$^3$.

On the resin film thus obtained, a coating solution for forming an adhesive layer having the following composition was so coated according to a wire bar coating method that the thickness after drying became 5 μm, and dried.

| Coating solution for forming adhesive layer | |
|---|---|
| Epoxy resin Epikote 1001 (trade name, produced by Yuka Shell Epoxy K.K.) | 5 parts |
| Curing agent Epomate B-002 (trade name, produced by Yuka Shell Epoxy K.K.) | 5 parts |
| Methyl ethyl ketone | 80 parts |
| Cyclohexanone | 10 parts |

As a substrate, the white polyethylene terephthalate film used in Example 7 was used, and a resin film on which the above adhesive layer was provided was superposed on both surfaces of the substrate. The resin film and the substrate were so heated and contacted by a heat roll that bubbles were not generated, and then the adhesive layer was cured by heating at 100° C. for 2 hours to obtain a laminated resin sheet. On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLE 21 TO 26

Image receiving sheets were prepared in the same manner except for changing the substrates used in Examples 15 to 20 to those used in Examples 8 to 13, respectively. By using the image receiving sheets obtained and the ink sheet of Example 1, images were formed and evaluated. The results are shown in Table 1.

EXAMPLE 27

Both surfaces of the polypropylene type synthetic paper used in Example 1 and the white polyethylene terephthalate film E60 (trade name, produced by Toray K.K.) having a thickness of 50 μm and a density of 0.8 g/cm$^3$ also used in Example 1 were subjected to hot melt extrusion lamination by using a low density polyethylene having a melt flow rate of 7 g/10 min to obtain a laminated resin sheet.

On one surface of the laminated resin sheet obtained, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

EXAMPLES 28 TO 52

The substrates used in Examples 2 to 26 and a resin film having a density in the range of 0.5 to 1.2 g/cm$^3$ were subjected to hot melt extrusion lamination in the same manner as in Example 27, respectively, to obtain laminated resin sheets.

On one surface of each laminated resin sheet obtained, an image receiving layer was formed in the same manner as in Example 1 by using the coating solution for forming an image receiving layer of Example 1 to obtain an image receiving sheet. By using these respective image receiving sheets and the ink sheet of Example 1, images were formed and evaluated. The results are shown in Table 1.

COMPARATIVE EXAMPLE 1

On one surface of a synthetic paper Yupo FPG#150 (trade name, produced by Oji Yuka Goseishi K.K.) having a thickness of 150 μm, which was used as a support, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

COMPARATIVE EXAMPLE 2

On one surface of a white polyethylene terephthalate film W400 (trade name, produced by Diafoil K.K.) having a thickness of 188 μm, which was used as a support, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

COMPARATIVE EXAMPLE 3

On one surface of a white polyethylene terephthalate film W400 (trade name, produced by Diafoil K.K.) having a thickness of 188 μm, which was used as a support, a coating solution for forming an intermediate layer having the following composition was so coated and dried that the dried film thickness became 10 μm. Subsequently, an image receiving layer was formed in the same manner as in Example 1 by using the coating solution for forming an image receiving layer of Example 1.

Then, the intermediate layer was foamed by heating treatment at 120° C. for 1 hour to form a porous layer. By using the image receiving sheet obtained and the ink sheet of Example 1, an image was formed and evaluated. The results are shown in Table 1.

| Coating solution for forming intermediate layer | |
|---|---|
| Polyvinyl chloride TK600 (trade name, produced by Shinetsu Kagaku Kogyo K.K.) | 9 parts |
| Azobisisobutyronitrile | 1 part |
| Methyl ethyl ketone | 80 parts |
| Cyclohexanone | 10 parts |

COMPARATIVE EXAMPLE 4

On one surface of a white polyethylene terephthalate film W900J (trade name, produced by Diafoil K.K.) having a thickness of 150 μm, which was used as a support, an image receiving layer was formed in the same manner as in Example 1 by using the coating solution for forming an image receiving layer of Example 1 to obtain an image receiving sheet. By using this image receiving sheet and the ink sheet of Example 1, an image was formed and evaluated. The results are shown in Table 1.

COMPARATIVE EXAMPLE 5

An image receiving sheet was prepared in the same manner as in Example 7 except for using a white polyethylene terephthalate film W400 (trade name, produced by Diafoil K.K.) having a thickness of 38 μm and a density of 1.45 g/cm$^3$ as a resin film and using the PEEK film used in Example 8 as a substrate. By using this image receiving sheet and the ink sheet of Example 1, an image was formed and evaluated. The results are shown in Table 1.

COMPARATIVE EXAMPLE 6

An image receiving sheet was prepared in the same manner as in Example 1 except for using a white polyethylene terephthalate film Melinex 329 (trade name, produced by ICI Co.) having a thickness of 50 μm and a density of 1.38 g/cm$^3$ as a resin film and using the polypropylene type synthetic paper used in Example 1 as a substrate. By using this image receiving sheet and the ink sheet of Example 1, an image was formed and evaluated. The results are shown in Table 1.

TABLE 1

| | Curling | Transfer density | Prevention of dye bleeding | Transfer sensitivity ($\times 10^{-3}$) | Presence or absense of white dots |
|---|---|---|---|---|---|
| Example 1 | ○ (0.7) | ◎ (2.7) | ○ | ◎ (4.4) | ○ |
| Example 2 | ○ (0.6) | ○ (2.4) | ○ | ◎ (4.5) | ○ |
| Example 3 | ◎ (0.1) | ◎ (2.6) | ○ | ◎ (4.5) | ○ |
| Example 4 | ○ (0.8) | ◎ (2.6) | ○ | ◎ (4.3) | ○ |
| Example 5 | ◎ (0) | ○ (2.2) | ○ | ○ (5.0) | ○ |
| Example 6 | ◎ (0.2) | ◎ (2.6) | ○ | ◎ (4.6) | ○ |
| Example 7 | ○ (0.9) | ◎ (2.8) | ○ | ◎ (4.3) | ○ |
| Example 8 | ◎ (0.1) | ○ (2.1) | ○ | ◎ (4.7) | ○ |
| Example 9 | ◎ (0.1) | ○ (2.2) | ○ | ◎ (4.8) | ○ |
| Example 10 | ◎ (0.1) | ○ (2.1) | ○ | ◎ (4.7) | ○ |
| Example 11 | ◎ (0.1) | ○ (2.3) | ○ | ◎ (4.7) | ○ |
| Example 12 | ◎ (0) | ○ (2.1) | ○ | ◎ (4.8) | ○ |
| Example 13 | ◎ (0.1) | ○ (2.1) | ○ | ◎ (4.7) | ○ |
| Example 14 | ◎ (0.1) | ○ (2.2) | ○ | ◎ (4.7) | ○ |
| Example 15 | ◎ (0.4) | ◎ (2.7) | ○ | ◎ (4.8) | ○ |
| Example 16 | ◎ (0.3) | ◎ (2.6) | ○ | ○ (4.9) | ○ |
| Example 17 | ◎ (0.3) | ◎ (2.6) | ○ | ○ (4.9) | ○ |
| Example 18 | ◎ (0.1) | ○ (2.4) | ○ | ○ (5.0) | ○ |
| Example 19 | ◎ (0.6) | ◎ (2.7) | ○ | ○ (5.1) | ○ |
| Example 20 | ◎ (0.4) | ◎ (2.6) | ○ | ◎ (4.7) | ○ |
| Example 21 | ◎ (0.2) | ◎ (2.6) | ○ | ◎ (4.8) | ○ |
| Example 22 | ◎ (0.2) | ◎ (2.7) | ○ | ○ (5.0) | ○ |
| Example 23 | ◎ (0.2) | ◎ (2.7) | ○ | ○ (4.9) | ○ |
| Example 24 | ◎ (0.1) | ○ (2.5) | ○ | ○ (4.9) | ○ |
| Example 25 | ◎ (0.1) | ○ (2.5) | ○ | ○ (4.9) | ○ |
| Example 26 | ◎ (0.1) | ◎ (2.6) | ○ | ◎ (4.7) | ○ |
| Example 27 | ○ (0.8) | ◎ (2.8) | ○ | ◎ (4.4) | ○ |
| Example 28 | ○ (0.6) | ○ (2.5) | ○ | ◎ (4.4) | ○ |
| Example 29 | ◎ (0.1) | ◎ (2.7) | ○ | ◎ (4.5) | ○ |
| Example 30 | ◎ (0.4) | ◎ (2.6) | ○ | ◎ (4.2) | ○ |
| Example 31 | ◎ (0) | ○ (2.4) | ○ | ○ (4.9) | ○ |

TABLE 1-continued

| | Curling | Transfer density | Prevention of dye bleeding | Transfer sensitivity ($\times 10^{-3}$) | Presence or absense of white dots |
|---|---|---|---|---|---|
| Example 32 | ◎ (0.2) | ◎ (2.7) | ○ | ◎ (4.6) | ○ |
| Example 33 | ○ (0.7) | ◎ (2.8) | ○ | ◎ (4.3) | ○ |
| Example 34 | ◎ (0.1) | ○ (2.2) | ○ | ◎ (4.6) | ○ |
| Example 35 | ◎ (0.1) | ○ (2.3) | ○ | ◎ (4.7) | ○ |
| Example 36 | ◎ (0.1) | ○ (2.2) | ○ | ◎ (4.8) | ○ |
| Example 37 | ◎ (0.1) | ○ (2.3) | ○ | ◎ (4.6) | ○ |
| Example 38 | ◎ (0.1) | ○ (2.5) | ○ | ◎ (4.6) | ○ |
| Example 39 | ◎ (0.1) | ○ (2.4) | ○ | ◎ (4.6) | ○ |
| Example 40 | ◎ (0.1) | ◎ (2.6) | ○ | ◎ (4.6) | ○ |
| Example 41 | ◎ (0.1) | ○ (2.5) | ○ | ◎ (4.7) | ○ |
| Example 42 | ◎ (0.2) | ◎ (2.7) | ○ | ○ (4.9) | ○ |
| Example 43 | ◎ (0.3) | ◎ (2.7) | ○ | ○ (4.9) | ○ |
| Example 44 | ◎ (0.1) | ○ (2.5) | ○ | ○ (4.9) | ○ |
| Example 45 | ○ (0.6) | ◎ (2.8) | ○ | ○ (5.0) | ○ |
| Example 46 | ◎ (0.4) | ◎ (2.7) | ○ | ◎ (4.7) | ○ |
| Example 47 | ◎ (0.3) | ◎ (2.8) | ○ | ◎ (4.7) | ○ |
| Example 48 | ◎ (0.2) | ◎ (2.8) | ○ | ○ (4.9) | ○ |
| Example 49 | ◎ (0.1) | ◎ (2.6) | ○ | ○ (4.9) | ○ |
| Example 50 | ◎ (0.1) | ○ (2.5) | ○ | ○ (4.9) | ○ |
| Example 51 | ◎ (0.1) | ○ (2.5) | ○ | ○ (4.9) | ○ |
| Example 52 | ◎ (0.1) | ◎ (2.8) | ○ | ◎ (4.6) | ○ |
| Comparative example 1 | X (2.1) | ◎ (2.8) | X | ○ (4.9) | ○ |
| Comparative example 2 | ○ (0.6) | X (1.6) | ○ | X (5.7) | X |
| Comparative example 3 | ○ (0.6) | ○ (2.2) | Δ | Δ (5.3) | Δ |
| Comparative example 4 | Δ (1.2) | ○ (2.1) | ○ | Δ (5.4) | X |
| Comparative example 5 | ◎ (0.4) | X (1.6) | ○ | X (5.8) | Δ |
| Comparative example 6 | ○ (0.7) | Δ (1.9) | ○ | Δ (5.4) | Δ |

According to the image receiving sheet for thermal transfer recording of the present invention, curling is not caused during printing, excellent dimensional stability can be obtained, bleeding and white dots are not generated, and high sensitivity and high transfer density can be obtained.

We claim:

1. In an image receiving sheet for thermal transfer recording comprising: a support and a thermal transfer image receiving layer provided on a surface of the support and which contains a resin having drying affinity for a thermally diffusible dye provided thereon; the improvement comprising said support comprising a substrate having a first side and a second side; a first porous resin film being laminated on the first side; a second porous resin film being laminated on the second side; and said first and second porous resin film each being mainly composed of a polyester resin and having a density in the range of 0.5 to 1.2 g/cm$^3$.

2. The sheet of claim 1 wherein the porous resin film has a density in the range of 0.8 to 1.1 g/cm$^3$.

3. The sheet of claim 1 wherein the porous resin film further contains a white fine grain.

4. The sheet of claim 1 wherein the porous resin film further contains an antistatic agent.

5. The sheet of claim 1 wherein the porous resin film is obtained by a method in which a porous resin film having a desired thickness is obtained by adding an incompatible resin or a filler to a resin, extruding the mixture by an extrusion method, then biaxially stretching it to generate fine voids.

6. The sheet of claim 1 wherein the substrate is a synthetic paper comprising a white pigment layer coated on at least one surface of a polyolefin, polyester and/or resin film.

7. The sheet of claim 1 wherein the substrate is mainly composed of a resin selected from the following Group A:

Group A: polyether ether ketone, polysulfone, polyether sulfone, polyether imide, polyimide, polyphenylene sulfide, polycarbonate, a polyparabanic acid resin, a styrene resin and a vinyl chloride type resin.

8. The sheet of claim 7 wherein the porous resin film is composed mainly of polyester resin with a density of 0.8 to 1.1 g/cm$^3$; and the substrate has a thickness of 20 to 1000 μm.

9. The sheet of claim 1 wherein the substrate has a thickness of 20 to 1000 μm.

* * * * *